United States Patent [19]

Danin

[11] Patent Number: 4,457,105

[45] Date of Patent: Jul. 3, 1984

[54] BARRIER ASSEMBLY

[76] Inventor: Alex Danin, 1080 Mamaroneck Ave., White Plains, N.Y. 10605

[21] Appl. No.: 393,722

[22] Filed: Jun. 30, 1982

[51] Int. Cl.[3] ..... E01F 13/00

[52] U.S. Cl. ..... 49/49; 49/141

[58] Field of Search ..... 49/49, 35, 141; 250/200, 214

[56] References Cited

U.S. PATENT DOCUMENTS

| | | | |
|---|---|---|---|
| 2,877,284 | 3/1959 | Schultz | 250/200 X |
| 2,927,214 | 3/1960 | Hoffman | 250/214 R |
| 3,394,498 | 7/1968 | Reinitz et al. | 49/141 |
| 3,681,751 | 8/1972 | Le Barre | 49/49 X |
| 3,781,549 | 12/1973 | Fletcher et al. | 250/214 X |
| 3,849,936 | 11/1974 | Geraci | 49/49 X |
| 3,968,596 | 7/1976 | Danin | 49/49 |

*Primary Examiner*—Philip C. Kannan

*Attorney, Agent, or Firm*—Steinberg & Raskin

[57] ABSTRACT

An improved barrier assembly for selectively preventing and allowing travel along a path includes a frame assembly situated beside the path, at least one elongated barrier arm having a blocking position projecting laterally from the frame assembly across the path for preventing travel past the barrier arm along the path when the barrier arm is in the blocking position, and a connecting assembly connecting the barrier arm to the frame assembly for swinging movement with respect thereto about a substantially horizontal axis between the blocking position extending across the path and a non-blocking position wherein the barrier arm extends substantially vertically along the frame assembly to be situated with the latter beside the path to permit travel therealong. According to the invention the frame assembly comprises a channel enclosure to which a barrier arm is connected by the connecting means, the channel enclosure being constituted by a member having a substantially C-shaped cross-section. The particular configuration of the channel enclosure constituting at least a part of the frame means allows the barrier assembly to have a variety of configurations and be mounted in a variety of different manners as well as provided with automatic drive apparatus and safety release arrangements. Moreover, by virtue of the use of the channel enclosure, the barrier assembly will have a slim design when the arm is in the non-blocking position whereby less space will be occupied thereby than in conventional arrangements.

17 Claims, 26 Drawing Figures

BARRIER ASSEMBLY

BACKGROUND OF THE INVENTION

The present inventon relates generally to barriers for preventing vehicles from travelling along predetermined paths although it is understood that the invention has applicability to similarly controlling pedestrian traffic as well.

More particularly, the present invention constitutes an improvement in vehicle barriers of the general type disclosed in applicant's U.S. Pat. No. 3,968,596. Such vehicle barriers include an upright support means situated beside the path of travel of a vehicle, e.g., at the entrance to a parking space, and an elongated barrier arm having a blocking position when it projects laterally from the upright support means across the path for preventing the vehicle from travelling past the barrier arm along this path when the barrier arm is in its blocking position. A connecting means connects the barrier arm to the upright support means for swinging movement with respect thereto about a substantially horizontal axis between the blocking position extending across the path and a non-blocking position where the barrier arm extends substantially vertically along the upright support means to permit a vehicle to travel along the path. In particular the connecting means connects the arm to the support means for swinging movement in an upward direction from the blocking to the non-blocking position and in a downward direction from the non-blocking to the blocking position. Moreover, the axis around which the arm swings is situated at a region of the lower end of the arm when the latter is in its non-blocking position.

Such vehicle barriers are advantageous in that the barrier arm may be relatively long yet be easily swingable between its blocking and non-blocking positions without requiring exertion of relatively large forces so that any individual, even though not particularly strong, can easily swing the barrier arm between its blocking and non-blocking positions. The fact that the barrier arm can be considerably longer than, for example, arms of vehicle barriers of the type wherein the arm is pivoted at its end to an upright support and is swingable upwardly to the blocking position, makes it possible to use such vehicle barriers in a variety of different applications, such as at the entrance to a large parking area in order to prevent unauthorized vehicles from entering into the parking area. Moreover, the upright support means of such vehicle barriers can be relatively slender and short resulting in considerale savings in material costs.

It has been found, however, that the vehicle barriers of the general type disclosed in U.S. Pat. No. 3,968,596 are not always entirely satisfactory. More particularly, the upright support means from which the elongated barrier arm projects has the construction of an I-beam which is generally embedded in the ground on which the vehicle travels. Thus, in cases where an existing upstanding structure, such as a wall or a column, is situated adjacent to the entrance to the path of travel of the vehicle, it has been necessary to embed the upright support means in the ground adjacent to the wall or column thereby taking up a valuable three or four inches of clearance space which would otherwise be available and through which the vehicle could pass. In cases where space limitations are critical, e.g., where a parking space provides a minimal clearance between the wall or column situated at its entrance, the provision of an I-beam embedded in the ground next to the existing structure, even when placed as close as possible thereto, still eliminates valuable clearance space making it that much more difficult for an authorized vehicle to nevigate into the parking space. The use of I-beams as upright support means aggravated this problem to some extent in that the side walls constituting the same are relatively long thereby taking up even further valuable clearance space.

Another problem presented by the vehicle barriers of the type disclosed in the above-mentioned patent is that when the barrier arm is in its blocking position and is impacted against by, for example, an unauthorized vehicle attempting to travel past the same, it is possible that the vehicle barrier will be subjected to serious structural damage. Since the upright support means is embedded in the ground and the barrier arm is pivoted thereto about a horizontal axis, the application of a force to the barrier arm tending to push the arm around the upright support means will tend to stress and possibly break or deform the various components.

SUMMARY OF THE INVENTION

Accordingly, one object of the present invention is to provide a new and improved vehicle barrier which will avoid the above drawbacks.

In particular it is an object of the present invention to provide a new and improved vehicle barrier assembly having a slim design and wherein the barrier arm may be of any desired length while being easily swingable between its blocking and non-blocking positions without requiring exertion of relatively large forces.

Another object of the present invention is to provide a new and improved vehicle barrier assembly including frame means which are selectively capable of either being embedded in the ground to function as a support means for the arm or being connected to an upstanding structure, such as a wall, column or stanchion, in any suitable one of a variety of possible configurations, when such structure is situated adjacent to the path of travel of the vehicle, thereby providing valuable additional clearance space through which the vehicle can pass.

Still another object of the present invention is to provide a new and improved vehicle barrier assembly of the type described above and having a feature wherein the assembly will pivot or fold about a vertical axis when the barrier arm is in its blocking position and subjected to a force in the direction of folding so as to avoid serious structural damage to the assembly.

A further object of the present invention is to provide a new and improved vehicle barrier assembly of the type described above including frame means which may be operatively associated with the frame means of a similar assembly to form a combined assembly including two barrier arms.

A still further object of the present invention is to provide a new and improved vehicle barrier assembly of the above type which can be easily modified for motorized and automatic operation.

In addition, it is an object of the present invention to provide a construction of the above general type which is exceedingly economical and rugged while at the same time being very reliable in operation, lending itself to easy manufacture and installation.

Briefly, in accordance with the present invention these and other objects are attained by providing in a vehicle barrier assembly which includes an elongate barrier arm adapted for swinging movement about a substantially horizontal axis between a blocking position extending across the path and a non-blocking position where the barrier arm extends substantially vertically beside the path to permit a vehicle to travel therealong, the improvement comprising that the barrier arm is connected by connecting means to a so-called universal frame means which is selectively capable of either being embedded in the ground beside the path of travel to function as an upright support means for the barrier arm or connected to an upstanding structure, such as a wall, column or stanchion, in any suitable one of a variety of possible configurations when such upstanding structure is itself beside the path of travel. In the preferred embodiment, the frame means is constituted by a channel enclosure having a substantially C-shaped cross-section along its length.

The channel enclosure can thus have its lower end region embedded in the ground to constitute an upright support means for the barrier arm or, in the case where a wall, column or stanchion is situated beside the path of travel, the channel enclosure can be connected thereto without being embedded in the ground.

The channel enclosure has a small width, i.e., is extremely slim, so as to provide maximum clearance for the vehicle when the barrier arm is in the non-blocking position. Thus, the barrier assembly will occupy much less space in a parking area than conventional barriers which will be readily understood as being a significant advantage.

The channel enclosure can be connected to an existing wall or column, or to an embedded stanchion which has a similar cross-sectional configuration to that of the channel enclosure, utilizing a double acting hinge having a release mechanism which permits the barrier arm to pivot or fold back when struck by a vehicle from either the front or the rear without the possibility of the assembly incurring serious structural damage. The release mechanism may be constituted by shear pins which act as the hinge pins in the double acting hinge.

Moreover, the channel enclosure constituting the frame means of the invention may be interconnected to other similar frame means in a number of ways providing for maximum flexibility in installation as required. For example, a channel enclosure of one vehicle barrier assembly may be connected in back-to-back relationship with a channel enclosure of another barrier assembly so that the respective barrier arms of the dual barrier assembly combination extend in opposite directions when in their blocking positions. This is advantageous when the invention is applied to a row of parking spaces separated one from the next by a plurality of boundary lines in that such a vehicle barrier assembly combination need be provided only on alternate boundary lines thereby increasing the available space through which a vehicle can pass to enter and leave the parking space. In another embodiment, a channel enclosure of a barrier assembly may be connected in back-to-back relation with a similar channel which acts as an enclosure for a drive arrangement, such as a rotatable drive screw, which is operatively connected to the barrier arm of the assembly to drive the same.

In the case where the barrier arm is moved between the blocking and unblocking positions utilizing drive apparatus incorporating an electric drive motor, the voltage required to operate the motor may be provided either as a high or low voltage supplied from a remote panel through wires embedded in the ground. In a modification according to the present invention, the voltage may be provided by a battery pack operated by conventional remote radio transmitters and a corresponding radio receiver associated with the barrier assembly. Since this type of control requires a constant electric current to operate the radio receiver, a photo-voltaic cell can be placed on top of the channel enclosure to recharge the batteries on a continual basis.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figures 1, 2, 3, 4, 5, 6, 7, 8, 9:
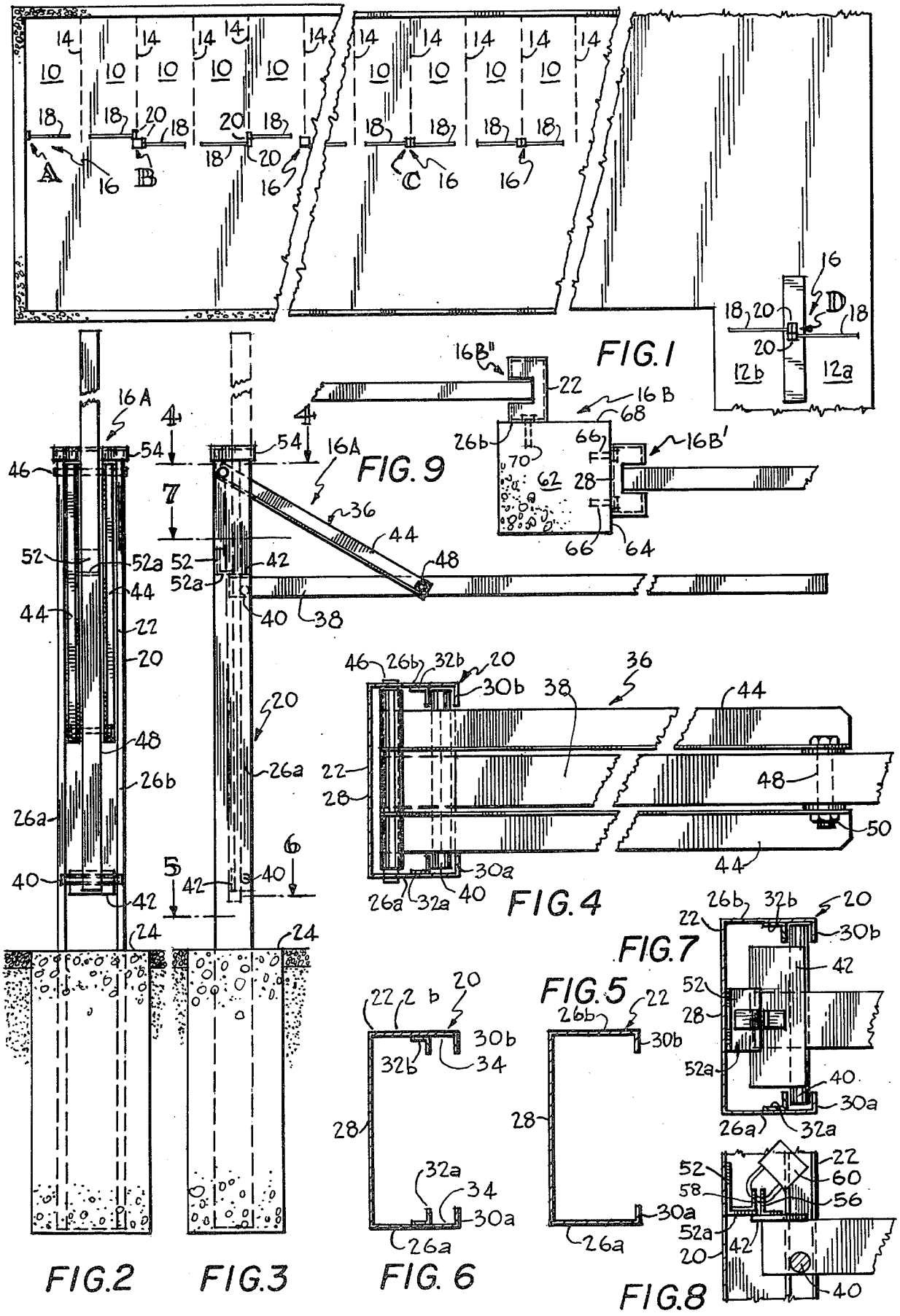
FIG. 1 is a schematic plan view of a system according to the present invention.
FIG. 2 is a partly sectional side elevation of an assembly according to the present invention shown in area A in FIG. 1.
FIG. 3 is a partly sectional front elevation of the assembly illustrated in FIG. 2.
FIG. 4 is a section view taken along line 4—4 in FIG. 3.
FIG. 5 is a section view taken along a line designated 5 in FIG. 3.
FIG. 6 is a section view taken along a line designated 6 in FIG. 3.
FIG. 7 is a section view taken along a line designated 7 in FIG. 3.
FIG. 8 is a fragmentary partly sectional front view of the assembly illustrated in FIG. 2 and showing a locking device therefore.
FIG. 9 is a plan view of an assembly according to the present invention shown in area B in FIG. 1.

Referring now to the drawings wherein like reference characters designate identical or corresponding parts throughout the several views, and more particularly to FIG. 1, there is schematically represented therein a row of parking stalls 10 constituting a parking lot serviced by an entrance path 12*a* and an exit path 12*b*. The parking stalls are separated one from the next by a plurality of boundary lines 14.

Situated beside each parking stall 10 and the entry and exit paths 12*a* and 12*b* is a vehicle barrier assembly, generally designated 16 in FIG. 1, according to the present invention. The several vehicle barrier assemblies are located at every other boundary line 14 as illustrated and includes at least one barrier arm 18 connected by connecting means to frame means 20. The barrier arms 18 can be moved between the blocking positions illustrated in FIG. 1 and non-blocking positions wherein the barrier arms 18 extend vertically along the frame means 20. The dimensions of the barrier arms 18 are appropriately chosen such that the free end of each barrier arm is located at a distance of preferably about 2 feet from the adjoining boundary line. As a result, the free ends of a pair of barrier arms 18 which extend toward each other from a pair of successive barrier assemblies, when the arms 18 are in their blocking positions as illustrated in FIG. 1, are spaced from each other by a distance of only about 4 feet so that it is not possible for a vehicle to enter through the space between the free ends of a pair of arms which are in their blocking positions. The result is that those boundary lines 14 where there are no vehicle barrier assemblies do not require any posts or the like to prevent vehicles from entering into the parking spaces 10 when the arms 18 are in their blocking positions.

It will be understood that although the invention is described herein as applied to parking lot systems, other applications are equally contemplated such, for example, as at toll booths or as guards at railway platforms and the like.

Referring now to FIGS. 2–8, an embodiment of a barrier assembly according to the present invention and comprising a detail of the area designated A in FIG. 1 is illustrated. The barrier assembly, designated 16A, comprises a frame means 20, which in the illustrated embodiment includes a vertically extending channel enclosure 22 having a substantially C-shaped cross-section, which is embedded in the ground 24 on which the vehicle travels, the channel enclosure 22 extending vertically upwardly from the ground in a manner illustrated most clearly in FIGS. 2 and 3. Thus, the channel enclosure 22 has front and rear walls 26*a* and 26*b* interconnected at one of their ends by a web 28 and a pair of flanges 30*a* and 30*b* directed inwardly from the other ends of walls 26*a* and 26*b*. Moreover, the frame means 20 includes a pair of vertically extending angles 32*a* and 32*b*, each of which is connected, such as by welding, by one of its legs to a respective side wall 26*a* and 26*b* so that the other inwardly extending legs thereof define respective vertically extending channels 34 (FIG. 6) with the inwardly directed flanges 30*a* and 30*b*. As noted above, the frame means 20 is embedded within ground 24 and will thereby constitute an upright support means for the barier arm 18.

The barrier arm 18 is connected to the frame means 20 by connecting means 36 which enables the barrier arm 18 to move between the blocking position shown in solid lines FIG. 3 and the non-blocking position shown in phantom in FIG. 3. The connecting means 36 provides for the arm 18, at its inner end region 38, a substantially horizontal axis about which the arm 18 turns when moving between the blocking and non-blocking positions, this horizontal axis being formed by the axis of a rod 40 which extends transversely through and beyond the arm 18, the latter preferably being constituted by a hollow metal bar which may be of rectangular or square cross-section. The ends of rod 40 are slidably received in respective channels 34 defined in the frame means 20 as described above. Thus, the channels 34 and rod 40, the latter constituting a part of connecting means 36, form a guide means for guiding the arm 18 during its movement between its blocking and non-blocking positions while at the same time guide the horizontal axis about which the arm 18 turns for movement in a substantially vertical direction.

The connecting means 36 also includes a pair of links 44 which may take the form of a pair of angle irons. A pivot pin 46 extends through and is fixed to the upper end regions of links 44, the pivot pin extending at its free ends into a pair of openings respectively formed in the side walls 26*a* and 26*b* at the upper end region of frame means 20. Thus, in this way the links 44 of the connecting means 36 are pivotally connected to the frame means 20 adjacent to the upper end thereof.

The links 44 have lower end regions which are pivotally connected to the arm 18 between the opposed ends thereof. At their lower ends the links 40 define between themselves a space which receives a part of the arm 18, and a suitable bolt 48 extends through the lower ends of each pair of links 44 and the arm 18, the bolt being held in position, for example, by a nut 50 and suitable washers, so that in this way the lower ends of the pair of links 44 are pivotally connected to the arm 18 between the opposed ends of the latter.

In addition frame means 20 and arm 18 carry stop means for defining the extent to which the blocking arm will swing to its blocking position. Referring to FIGS. 7 and 8, an angle bracket 52 is welded to the inwardly facing surface of web 28. Bracket 52 includes a flange portion 52*a* which extends into the space defined within the frame means 20. A plate 42 is welded across the inner end region 38 of arm 18. It will be seen that when the arm 18 is in its blocking position, as seen in FIGS. 7 and 8, the plate 42 engages the flange portion 52*a* to prevent further swinging of the arm 18. Thus, the plate 42 functions as a stop plate in conjunction with flange portion 52*a*.

Moreover, the top of the channel enclosure 22 of frame means 20 is covered by a cap plate 54 formed with a notch through which the arm 18 extends when it is in its non-blocking position as seen in FIG. 2.

In operation, assuming that arm 18 is in its blocking position illustrated in solid lines in FIG. 3, then in order to swing the arm 18 to its non-blocking position, it is only necessary to raise the outer end region of the arm 18 distant from frame means 20. The arm 18 will swing about the axis of bolt 48 while the rod 40 will move downwardly in channels 34 toward the bottom thereof. To bring the arm back to its blocking position, it is swung in the opposite direction until the plate 42 attached to the inner end of arm 18 abuts the flange portion 52*a* of angle bracket 52. It will be seen that by virtue of the counterbalanced nature of the arm 18, the arm 18 will be very easily displaced to the non-blocking position and similarly to the blocking position from the non-blocking position. Moreover, as a result of this construction, it is apparent that the arm 18 may have a length considerably greater than the height of the frame means 20.

It is further possible to provide a releasable lock means for releasably locking the barrier arm 18 in its blocking position. Thus, referring to FIGS. 7 and 8, a pair of hasps, generally designated 56 and 58, are welded to the plate 42 and flange portion 52*a* of angle bracket 52, respectively. The hasps 56 and 58 have corresponding openings formed therethrough which become aligned with each other when the arm 18 is in the blocking position. It is therefore possible to insert a lock 60 (FIG. 8) through the aligned openings of the hasps in order to lock the arm in the blocking position.

In the embodiment of the vehicle barrier assembly disclosed above and designated 16A, the frame means includes a channel enclosure whose lower region is embedded in the ground so that the frame means serves as an upright support means for the barrier arm. The construction of the channel enclosure is advantageous in that its width is relatively small, i.e., the side walls 26*a* and 26*b* are relatively short such, for example, as about 3¼". Thus a maximum amount of clearance space is provided when the barrier assembly is situated beside the path of travel of the vehicle.

However, it is to be understood that an important feature of the present invention is that the channel enclosure of the frame means is also suitable for being directly connected to an upstanding structure, such as a wall, column or stanchion in any one of a variety of possible configurations when such structure is situated beside the path of travel of the vehicle. This is extremely advantageous since (a) it eliminates the necessity of embedding upright support means in the ground even when a wall or column is advantageously situated thereby providing a maximum clearance space, and (b) the barrier assembly has the dual capability of being mounted on either a stanchion-type support means or on a wall or the like making it possible for a contractor to use the same assembly in any given environment. Moreover, the channel enclosure may be advantageously provided with a feature whereby the assembly will pivot or fold about a vertical axis when the barrier arm is in its blocking position and is impacted against to avoid any structural damage in this case. Furthermore, the channel enclosure of the frame means may be operatively associated with the channel enclosures of either similar barrier assemblies, so that each barrier assembly comprises a subassembly connected to form a combined assembly including two barrier arms, or with a channel enclosure which houses driving means for the barrier arm of the resulting assembly. Thus it is an important feature of the present invention that the channel enclosure of the frame means to which the barrier arm is connected has a universal applicability in all possible situations while still retaining the advantages inherent in the type of vehicle barriers disclosed in U.S. Pat. No. 3,968,596.

Referring to FIG. 9, an embodiment of a barrier assembly according to the present invention, designated 16B, is illustrated. The barrier assembly 16B is illustrated in the area designated B in FIG. 1. Assembly 16B is formed in conjunction with an upstanding structure in the form of a column 62 which is situated beside a pair of adjacent parking spaces 10 and includes first and second barrier subassemblies 16B' and 16B" connected to adjacent side surfaces of the column 62. More particularly, barrier subassembly 16B' is fixed to a surface 64 of column 62 which extends parallel to the boundary line 14 by bolts 66 passing through the web 28 of channel enclosure 22. On the other hand, the barrier subassembly 16B" is fixed to the adjacent column surface 68 which extends perpendicular to the boundary line 14 and transverse to the path of travel of the vehicle by bolts 70 passing through the side wall 26*b* of channel enclosure 22. The construction of the subassemblies 16B' and 16B" is otherwise essentially the same as that of barrier assembly 16A described above except that the respective channel enclosures 22 are substantially shorter than the corresponding channel enclosure 22 of the embodiment designated 16A. It is apparent from the foregoing that the particular configuration of the channel enclosure 22 enables the barrier to be connected directly to an upstanding structure and, in the case of a column, to be connected to either a side surface which extends substantially parallel or perpendicular to the boundary line of the parking space or path of travel of the vehicle. This is extremely advantageous in that it is no longer necessary to provide a separate upright support means embedded in the ground and as a result a maximum clearance will be provided through which the vehicle can pass. Moreover, significant cost economies are realized through the shortening of the respective channel enclosures 22.

Figures 10, 11, 12, 13, 14, 15, 16, 17:
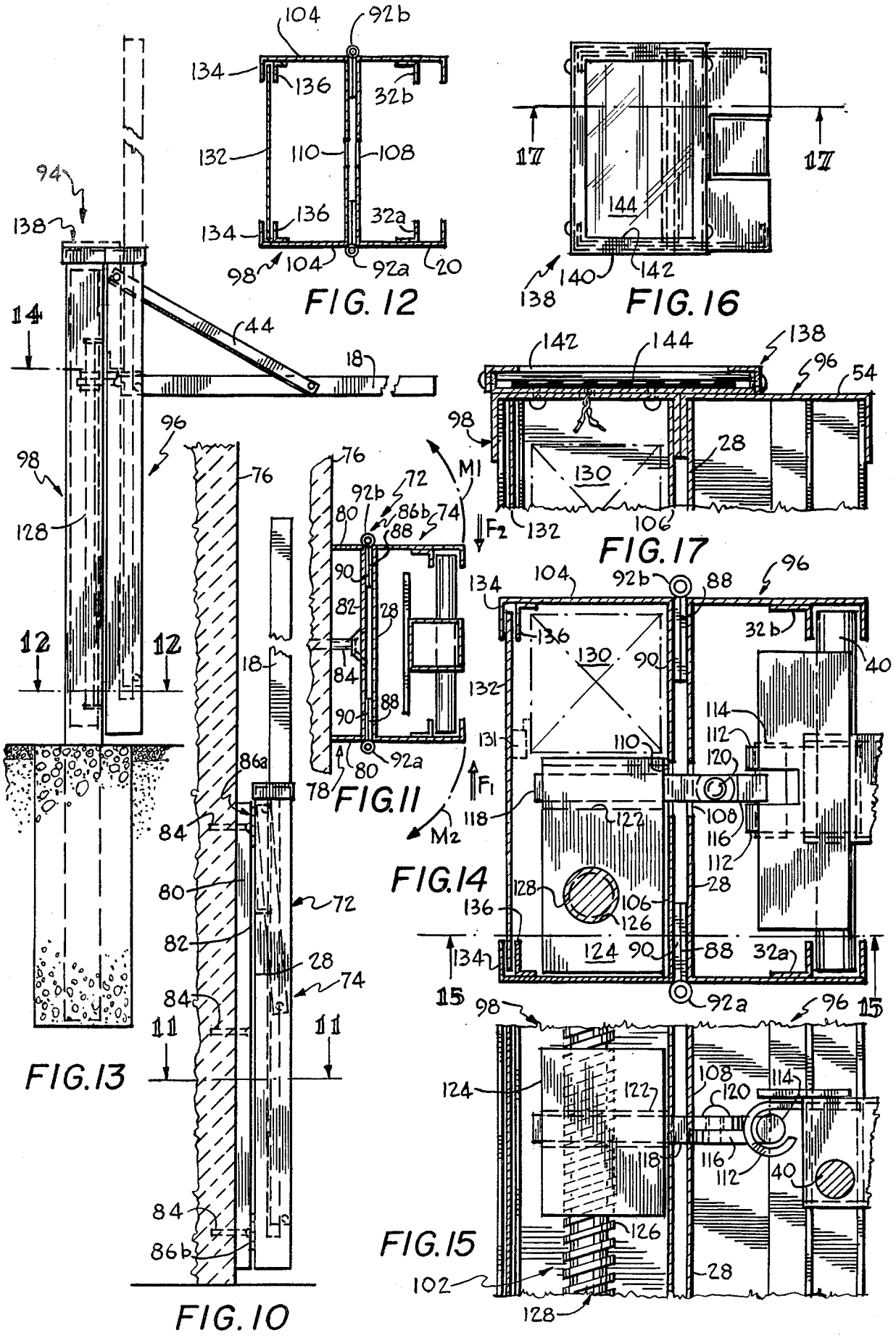
FIG. 10 is a partly sectional front elevation of an assembly according to the present invention connected to a wall or column by a double acting hinge.
FIG. 11 is a section view taken along line 11—11 of FIG. 10.
FIG. 12 is a section view taken along line 12—12 of FIG. 13.
FIG. 13 is a front elevation of an assembly according to the present invention including a channel enclosure housing drive means.
FIG. 14 is a section view taken along a line designated 14 of FIG. 13.
FIG. 15 is a section view taken along line 15—15 of FIG. 14.
FIG. 16 is a top plan view of the assembly illustrated in FIG. 13.
FIG. 17 is a section view taken along line 17—17 of FIG. 16.

Referring now to FIGS. 10–11, an embodiment of a barrier assembly according to the present invention, designated 72, is illustrated. The barrier assembly 72 is connected to an upstanding structure, such as a wall 76, but which may be a column or stanchion or the like, which is situated beside a path of travel of the vehicle. According to a feature of assembly 72, the barrier arm and associated frame means will pivot or fold about a vertical axis when the barrier arm is in its blocking position and is impacted against by a car or the like thereby avoiding any serious structural damage to the assembly. The barrier assembly 72 includes a barrier subassembly 74 having essentially the same construction as that of barrier assembly 16A except that the channel enclosure 22 thereof is significantly shorter than in the case of assembly 16A. Assembly 72 includes a vertically extending channel bracket 78 including a pair of side walls 80 and a web 82. The channel bracket 78 is fixed to the wall 76 with the free ends of side walls 80 abutting thereagainst by means of expansion bolts 84 or the like. As seen in FIG. 11, the web 82 of the channel bracket 78 is countersunk in appropriate locations so that the heads of bolts 84 are flush with the surface of web 82.

According to the invention, the barrier subassembly 74 is connected to the channel bracket 78 by means of a double acting hinge arrangement including two pairs of hinges 86*a* and 86*b* interconnecting the contiguous webs 28 and 82 of the barrier subassembly 74 and channel bracket 78. Referring to hinge pair 86*b* shown in FIG. 11, the hinges thereof include hinge plates 88 and 90 fixed to webs 28 and 82 respectively at their outer lateral edge region and hinge pins 92*a* and 92*b* hingedly interconnecting plates 88 and 90. The hinge pins are formed of a suitable material, such as plastic, which will shear when a sufficient force is applied to the barrier arm in a direction tending to rotate the same around the channel bracket 78. Thus, the hinge pins 92 will also function as shear pins. The hinge pair 86*a* has substantially the same construction as hinge pair 86*b*.

In the operation of the embodiment illustrated in FIGS. 10 and 11, when the barrier arm is in its blocking position and an impact force of sufficient strength is imparted thereto from the front as symbolically illustrated by arrow $F_1$, the hinge/shear pin 92*a* will shear whereupon the entire barrier subassembly 74 will fold or pivot around hinge/shear pins 92*b* as indicated by arrow $M_1$. Likewise, if an impact force of sufficient strength is imparted to the rear of the barrier arm as symbolically illustrated by arrow $F_2$, the hinge/shear pins 92*b* will shear whereupon the entire barrier subassembly 74 will fold or pivot around hinge/shear pins 92*a* as illustrated by arrow $M_2$. It will be readily apparent from the foregoing that by providing the double acting hinge and release mechanism constituted by the shear pins, any possibility of serious structural damage to the barrier assembly is eliminated.

It will also be understood that a double acting hinge mechanism of the type described above can be advantageously utilized in connection with many different arrangements of vehicle barrier assemblies according to the present invention by virtue of the construction of the channel enclosure of the frame means.

Referring now to FIGS. 12–17, an embodiment of a barrier assembly according to the present invention, designated 94 in FIG. 13, is illustrated. In this embodiment, a barrier subassembly 96 having essentially the same construction as the barrier assembly 16A is connected by a double acting hinge arrangement of the type described above to a channel enclosure 98 which is embedded in the ground 100 and which constitutes a housing for drive means 102 for swinging the barrier arm 18 between its blocking and non-blocking positions. Thus, when the invention is to be used at a location such as the entrance to a parking lot as in FIG. 1, for example, it is preferred to provide drive means for moving the arm 18 between its blocking and non-blocking position thereby rendering the vehicle barrier assembly automatically operable.

The channel enclosure 98 thus constitutes a channel member having a substantially C-shaped cross-section defined by a pair of side walls 104 and a web 106. A pair of aligned, vertically extending slots 108 and 110 are formed in the webs 28 and 106 as best seen in FIGS. 12, 14 and 16. Referring to FIGS. 14 and 15, the inner end of barrier arm 18 is bifurcated and is formed into a pair of hinge loops 112 having a substantially horizontal transverse axis. A hinge pin 114 is received in hinge loops 112 and a first connecting link 116 integrally extends from the central region of hinge pin 114 towards the aligned slots 108 and 110. The first connecting link 116 is pivotally connected to a second connecting link 118 by a bolt 120 or the like, the second connecting link 118 extending through the aligned slots 108 and 110 and loosely received in a horizontal bore 122 formed in a block 124 which also has an internally threaded vertical bore 126 formed therethrough. A rotary screw 128 of considerable length extends through the threaded bore 126 of block 124 and this screw 128 is driven from any suitable transmission by a motor 130 situated within the upper end of channel enclosure 98. The channel enclosure 98 may be closed by a cover plate 132 received within vertically extending channels defined by flanges 134 of the channel enclosure 98 and a pair of vertically extending angles 136 as best seen in FIGS. 12 and 14.

It will be understood that depending upon the direction of rotation of the screw 128 the arm 18 will be displaced in one direction or the other between its blocking and non-blocking positions with the hinge pin 114 rotating within the hinge loops 112. Moreover, should the barrier arm be subject to an impact force while in its blocking position, the release mechanism constituted by the shear/hinge pins 92*a* and 92*b* will allow the barrier subassembly 96 to fold or pivot, such folding being further permitted by the loose fit of the second connecting link 118 in bore 122 of block 124 and the pivotal connection of the first and second connecting links 116 and 118. It is therefore seen that the construction of the channel enclosures of the frame means of the present invention allows the combination of the barrier subassembly with a similar channel enclosure of the frame means which house drive means for the barrier arm while also incorporating the double acting hinge arrangement as well as all of the other advantages discussed above.

The electric motor 130 can be reversible with a manual control being provided to cause the motor to rotate in one direction or the other. Alternatively, the transmission between motor 130 and the screw 128 may be a reversible transmission operable through a clutch.

The voltage required to operate the motor may be provided either as a high or low voltage supplied from a remote panel through wires embedded in the ground.

According to another feature of the invention, since only relatively small forces are required to swing the barrier arm between its blocking and non-blocking positions due to its counterbalanced mounting as described above, it is possible to run the motor 130 using electricity from a battery pack which, of course, will be understood as constituting a significant advantage relative to the conventional situation wherein an electric current is required to be supplied through underground wires to all of the assemblies. Moreover, a remote control apparatus may be provided for switching the motor on and off, the control apparatus preferably comprising a radio transmitter at the remote location of the operator and a radio receiver, schematically illustrated at 131 in FIG. 14, situated within the channel enclosure 98.

Referring to FIGS. 16 and 17, since a constant electric current is required to operate such a radio receiver, a photo-voltaic cell assembly 138 comprising a metallic frame 140 provided with an open top 142 and in which one or more photo-voltaic cells 144 are housed, is mounted on the top end of the vehicle barrier assembly 94. A polycarbonate glazing is preferably provided over the cells 144. Thus, the photo-voltaic cells 144 will provide a constant recharging of the batteries and provide power for the radio receiver of the remote control apparatus.

In another embodiment, recharging of the batteries is provided by a low voltage wire buried in a shallow groove formed in the pavement and running from assembly to assembly from a central panel. The groove is filled with pavement material to embed the wire therein. Alternatively, a higher voltage, such as 25 volts, is run through the wire and stepped down to a desired voltage by a transformer.

Figure 18:
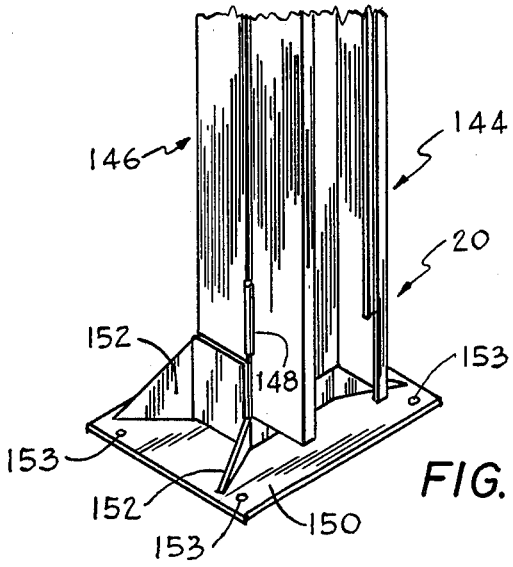
FIG. 18 is a fragmentary perspective view of an assembly according to the present invention wherein the frame means is connected by a double acting hinge to a stanchion which is fixed to the ground by a gusset-plate assembly.

Referring to FIG. 18, a fragmentary view of another embodiment of a vehicle barrier assembly according to the present invention is illustrated wherein the channel enclosure of a barrier subassembly 144 is connected to a stanchion formed of a channel enclosure 146 by means of a double action hinge arrangement 148. The channel enclosure 146 acts as an upright support means for subassembly 144 but rather than being embedded in the ground as in the case of barrier assembly 16A, the channel enclosure 146 is fixed to the ground by means of a base plate 150 and reinforcing gusset plates 152. Openings 153 are formed in base plate 150 for passage of bolts or other connectors for fixing the plate to the ground.

Referring now to FIGS. 19–26, various arrangements of vehicle barrier assemblies according to the present invention are shown. As will be appreciated from the illustrated embodiments as well as from the embodiments already described above, a barrier assembly in accordance with the present invention will comprise at least one barrier arm and a frame means including at least one channel enclosure to which a respective one of the barrier arms is connected by connecting means. Thus, the barrier assembly may include a pair of barrier arms connected to a corresponding pair of channel enclosures which are themselves coupled to each other and which are also coupled to drive means housed within similar channel enclosures. The barrier assembly can be supported by either connecting the same to an embedded or otherwise fixed stanchion, which may itself comprise a channel enclosure, or be mountable on a wall or column beside the path of travel of the vehicle. Thus, the present invention provides for many different configurations of barrier assemblies and it is understood that the scope of the invention is not limited by the particular embodiments described above or below.

Figure 19:
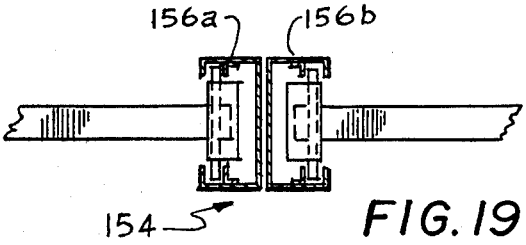

FIG. 19 illustrates a barrier assembly 154 comprising a pair of identical manually operable barrier subassemblies 156*a* and 156*b* having substantially the configurations of barrier assembly 16A and is a detail of the area marked C in FIG. 1. Barrier assembly 154 is formed by connecting, such as by bolts or welding, the outer surfaces of the webs of the two channel enclosures to each other.

Figure 20:
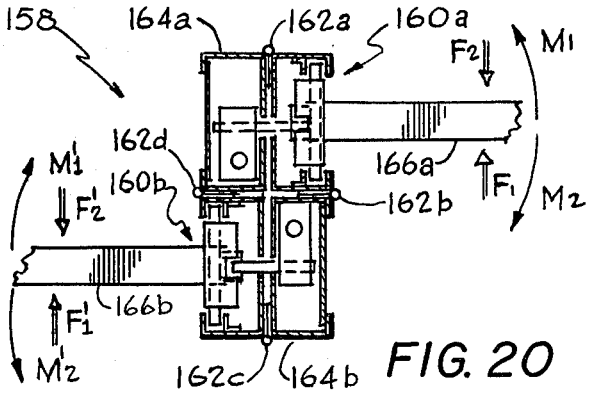

FIG. 20 illustrates a barrier assembly 158 comprising a pair of similar automatically operable barrier subassemblies 160*a* and 160*b* connected to each other by a 4-way hinge arrangement including 4 hinges having hinge/shear pins 162*a*, 162*b*, 162*c* and 162*d*. Such an arrangement is useful, for example, at adjacent entrance and exit paths of a parking lot and assembly 158 constitutes a detail of the area marked D in FIG. 1. Each barrier subassembly has substantially the same configuration as barrier assembly 94 described above. The channel enclosures 164*a* and 164*b*, which house the drive means for activating the corresponding barrier arms 166*a* and 166*b* which are connected to channel enclosures 168*a* and 168*b*, have their lower ends embedded in the ground. The 4-way hinge arrangement allows either barrier arm to fold back when impacted from either side thereof. Thus, when barrier arm 166*a* is impacted from the front by a certain force $F_1$, pin 162*b* will shear and barrier subassembly 160*a* will fold or pivot around pin 162*a* as shown by $M_1$. When barrier arm 166*a* is impacted from the rear by a force $F_2$, pin 162*a* will shear and barrier subassembly 160*a* will fold or pivot around pin 162*b* as shown by $M_2$. Similarly, when barrier arm 166*b* is impacted from the front by a force $F_1'$, pin 162*c* will shear and barrier subassembly 160*b* will fold or pivot around pin 162*d* as shown by $M_1'$. When arm 166*b* is impacted from the rear by a force $F_2'$, pin 162*d* will shear and barrier subassembly 160*b* will fold or pivot around pin 162*c* as shown by $M_2'$.

Figure 21:
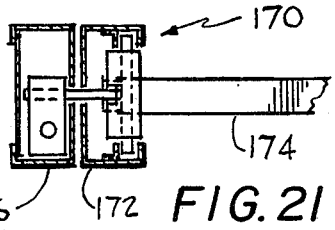

FIG. 21 illustrates a barrier assembly 170 substantially similar to barrier assembly 94. It differs therefrom, however, in that the channel enclosure 172 to which the barrier arm 174 is attached is embedded in the ground while the channel enclosure 176 housing the drive mechanism may be fixed to the channel enclosure 172 by welding or the like.

Figure 22:
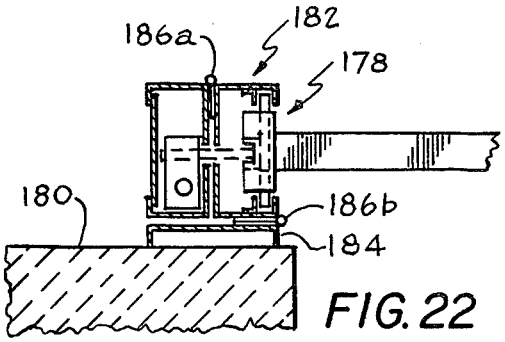
FIGS. 19-26 are cross-sectional views taken in a horizontal plane of various configurations of assemblies according to the present invention and illustrating various combination assemblies and manners of attachment to upstanding structures.

FIG. 22 illustrates a barrier assembly 178 mounted on the surface 180 of a wall which extends transversely to the path of travel of the vehicle. Barrier assembly 178 comprises an automatically operable barrier subassembly 182 connected to a channel member 184 of the frame means which itself is fixed to a wall 180. A double acting hinge arrangement including hinges 186*a* and 186*b* is provided to permit the subassembly 182 to fold forwardly or rearwardly.

Figure 23:
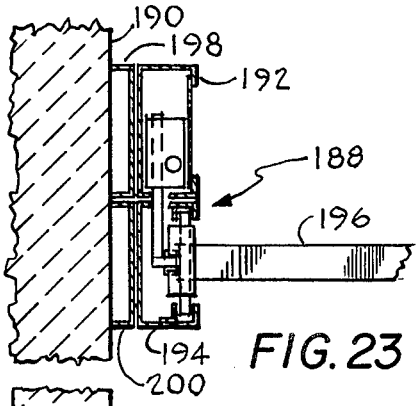

FIG. 23 illustrates an automatically operated barrier assembly 188 fixed to a wall or column 190. Barrier assembly 188 differs from the automatic assembly 170 shown in FIG. 21 in that the channel enclosure 192 housing the drive means is situated laterally with respect to the channel enclosure 194 to which the barrier arm 196 is connected, with each channel enclosure 194 and 196 being mounted on wall 190 through a corresponding channel member 198 and 200. In this case, it will be understood that aligned slots are formed in the adjoining side walls and not in the webs of the respective channel enclosures. Appropriate connecting lengths of the type described above in connection with the embodiment illustrated in FIG. 13, pass through the adjoining slots. The arrangement of barrier assembly 188 is particularly suited for applications wherein automatically operable assembly is desired but where a maximum of clearance space is necessary.

Figure 24:
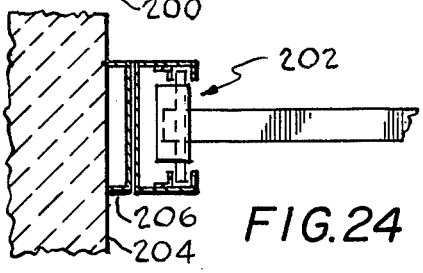

FIG. 24 illustrates a manually operable barrier assembly 202 of the type illustrated in FIG. 2 but mounted on a wall 204 situated beside the path of travel of the vehicle through a channel member 206.

Figure 25:
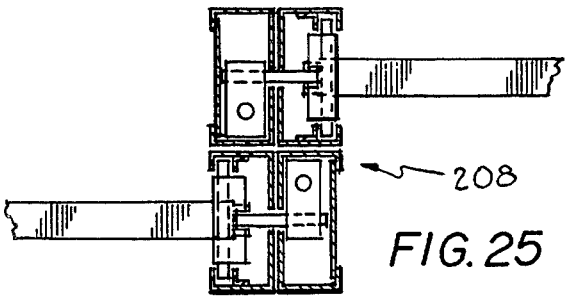

FIG. 25 illustrates an automatically operable barrier assembly 208 which is substantially the same as that illustrated in FIG. 20 except that the hinge release mechanism has been omitted with the channel enclosures being fixably connected to each other.

Figure 26:
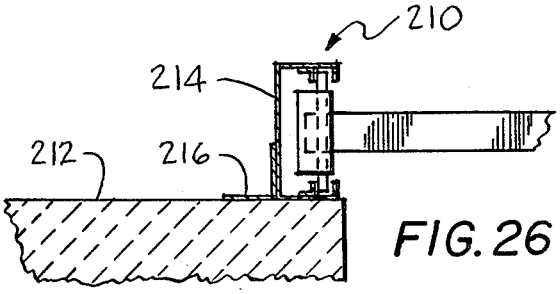

Finally, FIG. 26 illustrates a manually operable barrier assembly 210 mounted on the surface 212 of a wall which extends transversely to the path of travel of the vehicle. The channel enclosure 214 is fixed to wall surface 212 by means of an angle bracket 216 having its flanges connected, as by welding, to the wall and channel enclosure web.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In a barrier assembly for selectively preventing and allowing travel along a path including frame means situated beside said path, at least one elongated barrier arm having a blocking position projecting laterally from said frame means across said path for preventing travel past said barrier arm along said path when said barrier arm is in said blocking position, and connecting means connecting said barrier arm to said frame means for swinging movement with respect thereto about a substantially horizontal axis between said blocking position extending across said path and a non-blocking position where said barrier arm extends substantially vertically along said frame means to be situated with the latter beside said path to permit travel there along, the improvement comprising:

said frame means comprises a first channel enclosure to which a barrier arm is connected by said connecting means, said first channel enclosure being constituted by a member having a substantially C-shaped cross-section, and wherein said first channel enclosure is mounted to a stanchion fixed to the ground, said stanchion comprising a second channel enclosure connected to said first channel enclosure to which said barrier arm is connected.

2. The combination of claim 1 wherein said barrier assembly includes safety release means for permitting said barrier arm to pivot or fold about a vertical axis when a force exceeding a predetermined force is applied to said barrier arm.

3. The combination of claim 2 wherein said release means comprises hinge means hingedly connecting said first channel enclosure to which said barrier arm is connected to said second channel enclosure, said hinge means including a shear member.

4. The combination of claim 1 wherein said barrier assembly includes drive means for automatically swinging said barrier arm between said blocking and non-blocking positions.

5. The combination of claim 4 further including means associated with said barrier assembly for supplying power to said drive means.

6. The combination of claim 5 further including remote control means for actuating said drive means, said remote control means including a remote radio transmitter and a radio receiver associated with said barrier assembly.

7. The combination of claim 6 further including photovoltaic battery means associated with said barrier assembly for supplying electrical power to said remote radio transmitter.

8. The combination of claim 5 wherein said power supply means comprise a battery associated with said barrier assembly.

9. The combination of claim 8 wherein said battery is rechargeable and further including photovoltaic battery means associated with said barrier assembly for recharging said rechargeable battery.

10. In a barrier assembly for selectively preventing and allowing travel along a path including frame means situated beside said path, at least one elongated barrier arm having a blocking position projecting laterally from said frame means across said path for preventing travel past said barrier arm along said path when said barrier arm is in said blocking position, and connecting means connecting said barrier arm to said frame means for swinging movement with respect thereto about a substantially horizontal axis between said blocking position extending across said path and a non-blocking position where said barrier arm extends substantially vertically along said frame means to be situated with the latter beside said path to permit travel there along, the improvement comprising, said frame means comprises a first channel enclosure to which a barrier arm is connected by said connecting means, said first channel enclosure being constituted by a member having a substantially C-shaped cross-section; and said barrier assembly including safety release means for permitting said barrier arm to pivot or fold about a vertical axis when a force exceeding a predetermined force is applied to said barrier arm, said release means comprising a double acting hinge arrangement including a pair of hinges fixing respective lateral edge regions of said first channel enclosure to a fixed member, each of said hinges including a shear member, whereby said barrier arm will pivot or fold about a vertical axis when a force exceeding a predetermined force is applied to either the forward or rearward side of said barrier arm.

11. In a barrier assembly for selectively preventing and allowing travel along a path including frame means situated beside said path, at least one elongated barrier arm having a blocking position projecting laterally from said frame means across said path for preventing travel past said barrier arm along said path when said barrier arm is in said blocking position, and connecting means connecting said barrier arm to said frame means for swinging movement with respect thereto about a substantially horizontal axis between said blocking position extending across said path and a non-blocking position where said barrier arm extends substantially vertically along said frame means to be situated with the latter beside said path to permit travel there along, the improvement comprising:

said frame means comprises a first channel enclosure to which a barrier arm is connected by said connecting means, said first channel enclosure being constituted by a member having a substantially C-shaped cross-section;

a second channel enclosure connected to said first channel enclosure to which said barrier arm is connected, said first and second channel enclosures each comprising a member having a pair of side walls and a web interconnecting said side walls at an edge thereof, and wherein said first and second channel members are connected with respective side walls being contiguous with each other with respective aligned slots being formed in said side walls; and drive means for automatically swinging said barrier arm between said blocking and non-blocking positions, said drive means being housed within said second channel enclosure and coupled to said barrier arm through said aligned slots.

12. In a barrier assembly for selectively preventing and allowing travel along a path including frame means situated beside said path, at least one elongated barrier arm having a blocking position projecting laterally from said frame means across said path for preventing travel past said barrier arm along said path when said barrier arm is in said blocking position, and connecting means connecting said barrier arm to said frame means for swinging movement with respect thereto about a substantially horizontal axis between said blocking position extending across said path and a non-blocking position where said barrier arm extends substantially vertically along said frame means to be situated with the latter beside said path to permit travel there along, the improvement comprising:

said frame means of said barrier assembly comprises first and second channel enclosures, each having a pair of side walls and an interconnecting web defining a substantially C-shaped cross-section, and a pair of barrier arms, each being connected to a respective one of said first and second channel enclosures by said connecting means, said first and second channel enclosures being coupled to each other in back-to-back relationship with their respective webs being opposed and contiguous to each other, and wherein said first and second channel enclosures are coupled to each other by a pair of hinge means, each hinge means interconnecting respective side regions of said opposed webs, said hinge means including shear pin means.

13. In a barrier assembly for selectively preventing and allowing travel along a path including frame means situated beside said path, at least one elongated barrier arm having a blocking position projecting laterally from said frame means across said path for preventing travel past said barrier arm along said path when said barrier arm is in said blocking position, and connecting means connecting said barrier arm to said frame means for swinging movement with respect thereto about a substantially horizontal axis between said blocking position extending across said path and a non-blocking position where said barrier arm extends substantially vertically along said frame means to be situated with the latter beside said path to permit travel there along, the improvement comprising:

said frame means of said barrier assembly comprises first and second channel enclosures, each having a pair of walls and an interconnecting web defining a substantially C-shaped cross-section, and a pair of barrier arms, each being connected to a respective one of said first and second channel enclosures by said connecting means, said first and second channel enclosures being coupled to each other; and wherein said first and second channel enclosures are connected to third and fourth channel enclosures respectively in back-to-back relationship with their respective webs being opposed and contiguous to each other, said third and fourth channel enclosures forming part of said frame means and housing drive means for swinging respective ones of said barrier arms connected to said first and second channel enclosures, whereby said first and third channel enclosures and associated barrier and drive means constitute a first barrier subassembly, while said second and fourth channel enclosures and associated barrier arm and drive means constitute a second barrier subassembly, said first and second barrier subassemblies being coupled to each other such that the respective barrier arms extend in opposite directions when in their blocking positions.

14. The combination of claim 13 further including safety release means for allowing said first barrier assembly to fold or pivot about a vertical axis when the barrier arm connected to said first channel enclosure is impacted against by a force greater than a certain predetermined force, and for allowing said second barrier assembly to fold or pivot about a vertical axis when the barrier arm connected to said second channel enclosure is impacted against by a force greater than a certain predetermined force.

15. The combination of claim 14 wherein said safety release means include first shear hinge means interconnecting said first and fourth channel enclosures, second shear hinge means interconnecting said first and third channel enclosures, third shear hinge means interconnecting said second and third channel enclosures, and fourth shear hinge means interconnecting said second and fourth channel enclosures.

16. In a barrier assembly for selectively preventing and allowing travel along a path including frame means situated beside said path, at least one elongated barrier arm having a blocking position projecting laterally from said frame means across said path for preventing travel past said barrier arm along said path when said barrier arm is in said blocking position, and connecting means connecting said barrier arm to said frame means for swinging movement with respect thereto about a substantially horizontal axis between said blocking position extending across said path and a non-blocking position where said barrier arm extends substantially vertically along said frame means to be situated with the latter beside said path to permit travel there along, the improvement comprising:

said frame means comprise first and second channel enclosures, each having a pair of side walls and an interconnecting web defining a substantially C-shaped cross-section, a barrier arm connected to said first channel enclosure by said connecting means and drive means for swinging said barrier arm being housed in said second channel enclosure, said first and second channel enclosures being coupled to each other in back-to-back relationship with their respective webs being opposed and contiguous to each other; and wherein said drive means are interconnected to said barrier arm by a pair of links pivotally interconnected to each other about a substantially vertical axis when said barrier arm is in its blocking position, and wherein said first and second channel enclosures are coupled to each other by a pair of hinge means, each hinge means interconnecting said regions of said opposed webs, said hinge means including shear pin means.

17. In a barrier assembly for selectively preventing and allowing travel along a path including frame means situated beside said path, at least one elongated barrier arm having a blocking position projecting laterally from said frame means across said path for preventing travel past said barrier arm along said path when said barrier arm is in said blocking position, and connecting means connecting said barrier arm to said frame means for swinging movement with respect thereto about a substantially horizontal axis between said blocking position extending across said path and a non-blocking position where said barrier arm extends substantially vertically along said frame means to be situated with the latter beside said path to permit travel there along, the improvement comprising:

said frame means comprise first and second channel enclosures, each having a pair of side walls and an interconnecting web defining a substantially C-shaped cross-section, a barrier arm connected to said first channel enclosure by said connecting means and drive means for swinging said barrier arm being housed in said second channel enclosure, said first and second channel enclosures being coupled to the other with respective ones of said side walls being opposed and contiguous to each other.

* * * * *